US006716299B1

(12) United States Patent
Gotkis et al.

(10) Patent No.: US 6,716,299 B1
(45) Date of Patent: Apr. 6, 2004

(54) PROFILED RETAINING RING FOR CHEMICAL MECHANICAL PLANARIZATION

(75) Inventors: Yehiel Gotkis, Fremont, CA (US); Aleksander Owczarz, San Jose, CA (US); Jeffrey Yung, Hayward, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/186,944

(22) Filed: Jun. 28, 2002

(51) Int. Cl.[7] ..... B24B 5/00; B24B 29/00
(52) U.S. Cl. ..... 156/345.14; 156/345.12
(58) Field of Search ..... 156/345.12, 345.14

(56) References Cited

U.S. PATENT DOCUMENTS 5,664,988 A * 9/1997 Stroupe et al. ..... 451/41
6,206,768 B1 * 3/2001 Quek ..... 451/287
6,464,566 B1 * 10/2002 Berman et al. ..... 451/36

* cited by examiner

*Primary Examiner*—Gregory Mills
*Assistant Examiner*—Sylvia R. MacArthur
(74) *Attorney, Agent, or Firm*—Martine & Penilla, LLP

(57) ABSTRACT

An invention is provided for a retaining ring for use in a chemical mechanical planarization system. The retaining ring includes an annular retaining ring capable of holding a flatted wafer in position during a CMP operation. The flatted wafer has a first corner and a second corner disposed on a flatted edge of the wafer. Also included is a plurality of profiled teeth disposed along an interior surface of the annular retaining ring. The profiled teeth are separated from each other such that the first comer and the second corner of the wafer do not contact profiled teeth simultaneously at all orientations of the wafer in the retaining ring. In addition, a surface of each tooth that contacts the wafer is inclined so as to form an angle greater than 90° relative to a polishing surface and away from the center of the wafer.

16 Claims, 9 Drawing Sheets

PROFILED RETAINING RING FOR CHEMICAL MECHANICAL PLANARIZATION

BACKGROUND OF THE INVENTION

1. Field of the Invention

This invention relates generally to chemical mechanical planarization, and more particularly to a non-coherent profiled retaining ring for reducing non-uniformity during a chemical mechanical planarization process.

2. Description of the Related Art

In the fabrication of semiconductor devices, planarization operations are often performed, which can include polishing, buffing, and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. Patterned conductive layers are insulated from other conductive layers by dielectric materials, such as silicon dioxide.

As semiconductor fabrication is an automated process, techniques have been developed to ensure fabrication robots properly align wafers within each step of wafer fabrication. For example, wafers are often notched at a point along the edge of the wafer to facilitate proper wafer alignment. Other alignment techniques include the use of flatted wafers, wherein an edge of the wafer is flat (not rounded). However, as described in greater detail subsequently, flatted wafers often generate problems during particular wafer manufacturing processes, such as during wafer planarization.

As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal planarization operations are performed to remove excess metallization. Further applications include planarization of dielectric films deposited prior to the metallization process, such as dielectrics used for shallow trench isolation or for polymetal insulation. One method for achieving semiconductor wafer planarization is the chemical mechanical planarization (CMP) process.

In general, the CMP process involves holding and rubbing a typically rotating wafer against a moving polishing pad under a controlled pressure and relative speed. CMP systems typically implement orbital, belt, or brush stations in which pads or brushes are used to scrub, buff, and polish one or both sides of a wafer. Slurry is used to facilitate and enhance the CMP operation. Slurry is most usually introduced onto a moving preparation surface and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

As mentioned above, techniques have been developed to ensure fabrication robots properly align wafers within each step of wafer fabrication. Conventional CMP systems often have little trouble when polishing notched wafers.

Unfortunately, conventional CMP systems generally do not perform satisfactorily when processing flatted wafers.

FIG. 1 is a diagram showing a conventional carrier head 100 holding a flatted wafer 102. As illustrated in FIG. 1, the wafer 102 is held in position during CMP processing by a conventional retaining ring 104, which surrounds the wafer 102. Generally, a small distance delta exists between the edge of the wafer 102 and the interior surface of the retaining ring 104 to allow the wafer 102 to be easily positioned within the carrier head 100. During a CMP operation the carrier head 100 rotates in a direction 110 along a polishing belt or table, depending on the type of CMP system utilizing the carrier head 100. As mentioned above, the polishing surface moves beneath the wafer 102 during polishing.

The movement of the polishing surface causes a friction force 106, which is applied to the wafer 102. Because of the delta between the wafer 102 and the retaining ring 104, the friction force 106 pushes the wafer 102 in the direction of the polishing surface movement until the wafer is stopped by the retaining ring 104. Once the wafer 102 contacts the retaining ring 104, a reaction force 108 is generated from the retaining ring 104. Generally, the reaction force 108 does not contributed greatly to uniformity errors when the rounded edges of the wafer 102 come into contact with the retaining ring 104. However, because of the delta between the wafer 102 and the retaining ring 104, the wafer 102 rotates within the retaining ring 104. As a result, the comers of the flatted portion of the wafer 102 eventually come into contact with the retaining ring 104, as illustrated in FIG. 2.

FIG. 2 is an illustration showing prior art carrier head 100 when the flatted section of the wafer 102 contacts the conventional retaining ring 104. As above, the wafer 102 is held in position by the conventional retaining ring 104, which surrounds the wafer 102. However, as shown in FIG. 2, the wafer 102 has rotated such that two corners 200 of the flatted section of the wafer 102 are both in contact with the retaining ring 104.

The contact of the two corners 200 with the retaining ring 104 generates reaction forces 202 concentrated at the comers 200 of the flatted section of the wafer 102. As is well known to those skilled in the art, each reaction force 202 can be split into component forces 204*a* and 204*b* for easier analysis. In particular, each reaction force 202 comprises a first force component 204*a*, which is directed along the rounded edge of the wafer 102, and a second force component 204*b*, which is directed along the flatted edge of the wafer 102. Hence, the second force components 204*b* of the reaction force 202 from each comer 200 are opposed to each other, causing stress to wafer 102 from the corners 200. Unfortunately, the opposing second force components 204*b* cause the wafer 102 buckle near the flatted section, as shown by area 206. As a result, the buckled flatted wafer section 206 is pushed into the polishing surface, causing over-polishing in the flatted wafer section 206 as illustrated in FIG. 3.

FIG. 3 is an illustration showing a flatted wafer 102 resulting from a CMP operation using a conventional retaining ring. When the flatted wafer section 206 is buckled and, as a result, pushed into the polishing surface, non-uniformity results. In particular, the flatted area 206 of the wafer 102 is polished with an increased removal rate relative to the remaining sections of the wafer 102 because of the additional force present in the flatted area 206 during polishing. As a result, the flatted area 206 of the wafer 102 is over-polished. The resulting non-uniformity can have a dramatic negative effect on the devices formed on the wafer, often causing the entire wafer to be discarded.

In view of the foregoing, there is a need for CMP techniques and apparatuses that allow flatted wafers to be polished with an essentially uniform removal rate. In particular, the apparatuses should not allow over-polishing of the flatted section and should allow essentially uniform planarization during a CMP process.

SUMMARY OF THE INVENTION

Broadly speaking, the present invention fills these needs by providing a non-coherent profiled retaining ring that allows planarization of flatted wafers without over-polishing the flatted region of the wafer. In one embodiment, a retaining ring for use in a CMP system is disclosed that includes an annular retaining ring capable of holding a flatted wafer in position during a CMP operation. The flatted wafer has a first corner and a second corner disposed on a flatted edge of the wafer. The retaining ring further comprises a plurality of profiled teeth disposed along an interior surface of the annular retaining ring. The profiled teeth are separated from each other such that the first corner and the second corner of the wafer do not contact profiled teeth simultaneously at all orientations of the wafer in the retaining ring. In addition, the profiled teeth can be further separated such that a predefined variation in length of the flatted edge of the wafer will not cause the first comer and the second comer to contact profiled teeth simultaneously at all orientations of the wafer in the retaining ring. In this manner, embodiments of the present invention can account for wafer size variation.

An additional retaining ring for use in a CMP is disclosed in an additional embodiment of the present invention. As above, the retaining ring includes an annular retaining ring capable of holding a flatted wafer in position during a CMP operation. Also as above, the flatted wafer has a first comer and a second comer disposed on a flatted edge of the wafer. In addition, a plurality of profiled teeth is included that are disposed along an interior surface of the annular retaining ring. In this embodiment, a surface of each tooth that contacts the wafer is inclined so as to form an angle greater than 90° relative to a polishing surface and away from the center of the wafer. That is, an edge of the surface of each tooth that contacts the wafer closest to the polishing surface can also be closest to a center of the wafer. In this manner, the surface of each tooth that contacts the wafer can be inclined such that a lifting force is generated during the CMP operation that pushes the wafer in a direction away from the polishing surface.

A further retaining ring is disclosed for use in a CMP system in a further embodiment of the present invention. The retaining ring includes an annular retaining ring capable of holding a flatted wafer in position during a CMP operation. As above, the flatted wafer has a first corner and a second corner disposed on a flatted edge of the wafer. Also included is a plurality of profiled teeth disposed along an interior surface of the annular retaining ring. The profiled teeth are separated from each other such that the first corner and the second comer of the wafer do not contact profiled teeth simultaneously at all orientations of the wafer in the retaining ring. In addition, a surface of each tooth that contacts the wafer is inclined so as to form an angle greater than 90° relative to a polishing surface and away from the center of the wafer. Similar to above, the profiled teeth can be further separated such that a predefined variation in length of the flatted edge of the wafer will not cause the first comer and the second comer to contact profiled teeth simultaneously. Also as above, the surface of each tooth that contacts the wafer can be inclined such that a lifting force is generated during the CMP operation that pushes the wafer in a direction away from the polishing surface. Advantageously, each embodiment of the present invention can be utilized in a linear wafer planarization apparatus, and/or a table base wafer planarization apparatus.

Embodiments of the present invention advantageously avoid wafer bending, and thus over-polishing, by eliminating the two corner reaction force interaction during CMP operations. Furthermore, since the profiled teeth disposed completely around the interior surface of the retaining ring, this is true at all orientations of the wafer in the retaining ring. Moreover, by inclining the internal surfaces of the retaining ring, such as the ring itself or the profiled teeth of the profiled retaining ring, embodiments of the present invention can reduce friction force and edge effect. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a non-coherent profiled retaining ring that allows planarization of flatted wafers without over-polishing the flatted region of the wafer. Broadly speaking, embodiments of the present invention space the profiled teeth of the retaining ring such that the corners of a flatted wafer do not contact two or more profiled teeth simultaneously. In addition, the profiled teeth can be inclined to reduce wafer edge effect. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 4A:
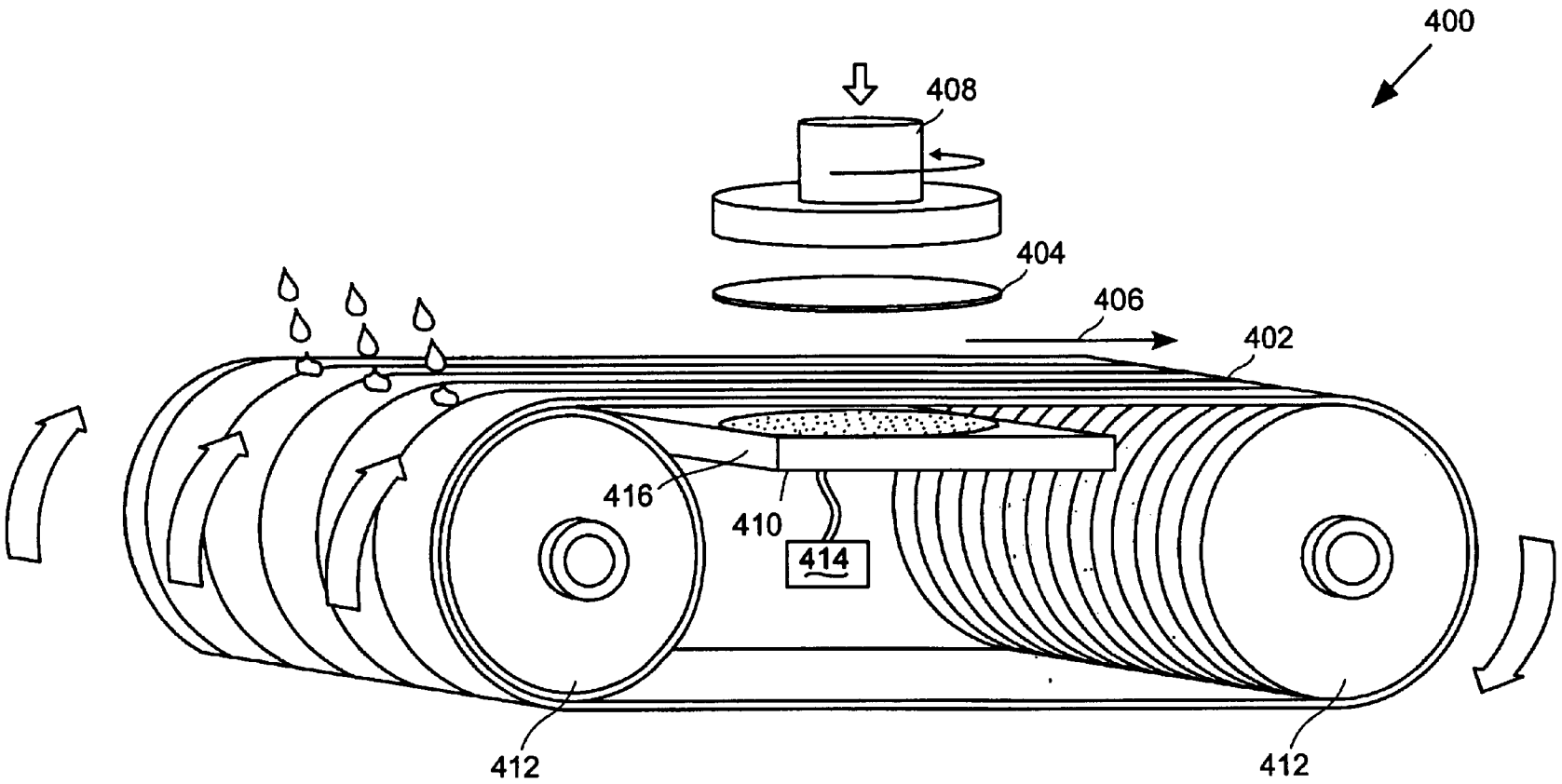
FIG. 4A shows a side view of a linear wafer polishing apparatus, in accordance with an embodiment of the present invention.

The profiled retaining ring of the embodiments of the present invention can be utilized in various CMP systems, such as table based CMP systems and linear CMP systems. For completeness, a brief description of these CMP systems follows. FIG. 4A shows a side view of a linear wafer polishing apparatus 400, in accordance with an embodiment of the present invention. The linear wafer polishing apparatus 400 includes a carrier head 408, which secures and holds a wafer 404 in place during processing. A polishing pad 402 forms a continuous loop around rotating drums 412, and generally moves in a direction 406 at a speed of about 400 feet per minute, however this speed may vary depending upon the specific CMP operation. As the polishing pad 402 moves, the carrier head 308 rotates and lowers the wafer 404 onto the top surface of the polishing pad 402, loading it with required polishing pressure.

A bearing platen manifold assembly 410 supports the polishing pad 402 during the polishing process. The platen manifold assembly 410 may utilize any type of bearing such as a fluid bearing or a gas bearing. The platen manifold assembly 410 is supported and held into place by a platen surround plate 416. Gas pressure from a gas source 414 is inputted through the platen manifold assembly 410 via a plurality of independently controlled of output holes that provide upward force on the polishing pad 402 to control the polishing pad profile. In addition to the linear belt CMP apparatus 400 discussed above, embodiments of the present invention can be used with table based CMP systems.

Figure 4B:
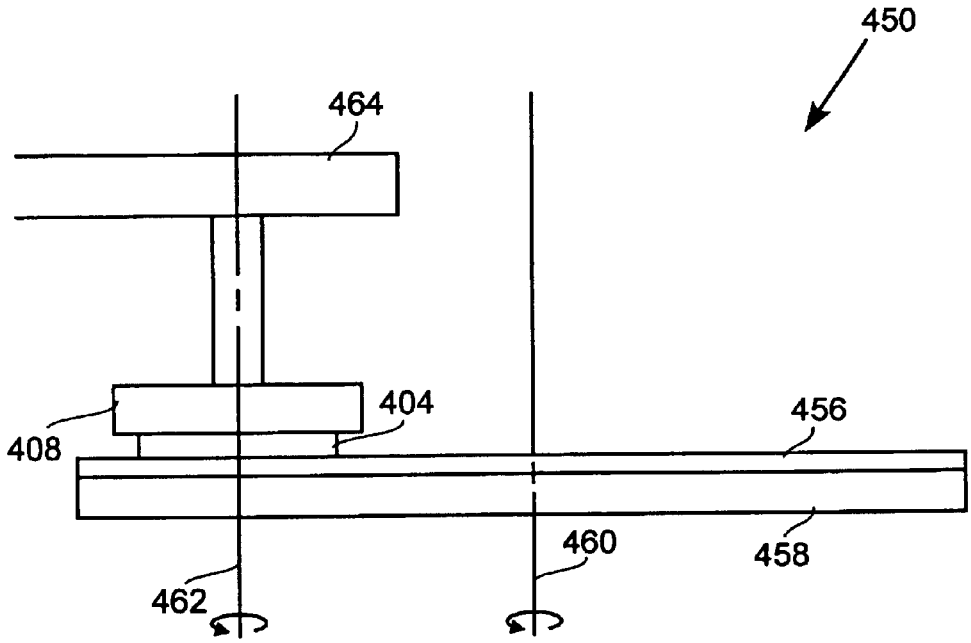
FIG. 4B is a diagram showing a table based CMP apparatus, in accordance with an embodiment of the present invention.

FIG. 4B is a diagram showing a table based CMP apparatus 450, in accordance with an embodiment of the present invention. The table based CMP apparatus 450 includes a carrier head 408, which holds a wafer 404, and is attached to a translation arm 464. In addition, the table based CMP apparatus 450 includes a polishing pad 456 that is disposed above a polishing table 458, which is often referred to as a polishing platen.

In operation, the carrier head 408 applies downward force to the wafer 404, which contacts the polishing pad 456. Reactive force is provided by the polishing table 458, which resists the downward force applied by the carrier head 408. A polishing pad 456 is used in conjunction with slurry to polish the wafer 404. Typically, the polishing pad 456 comprises foamed polyurethane or a sheet of polyurethane having a grooved surface. The polishing pad 456 is wetted with a polishing slurry having both an abrasive and other polishing chemicals. In addition, the polishing table 458 is rotated about its central axis 460, and the carrier head 408 is rotated about its central axis 462. Further, the polishing head can be translated across the polishing pad 456 surface using the translation arm 464.

In both the above described CMP apparatuses, the carrier head includes a profiled retaining ring usable for polishing flatted wafers. More particularly, the profiled teeth of the retaining ring prevent opposing reaction force components from bending the wafer, and thus over-polishing the surface of the wafer. It should be noted that, in addition to flatted wafers, the profiled retaining ring of the embodiments of the present invention can be utilized to planarize notched wafers as well.

Figure 5:
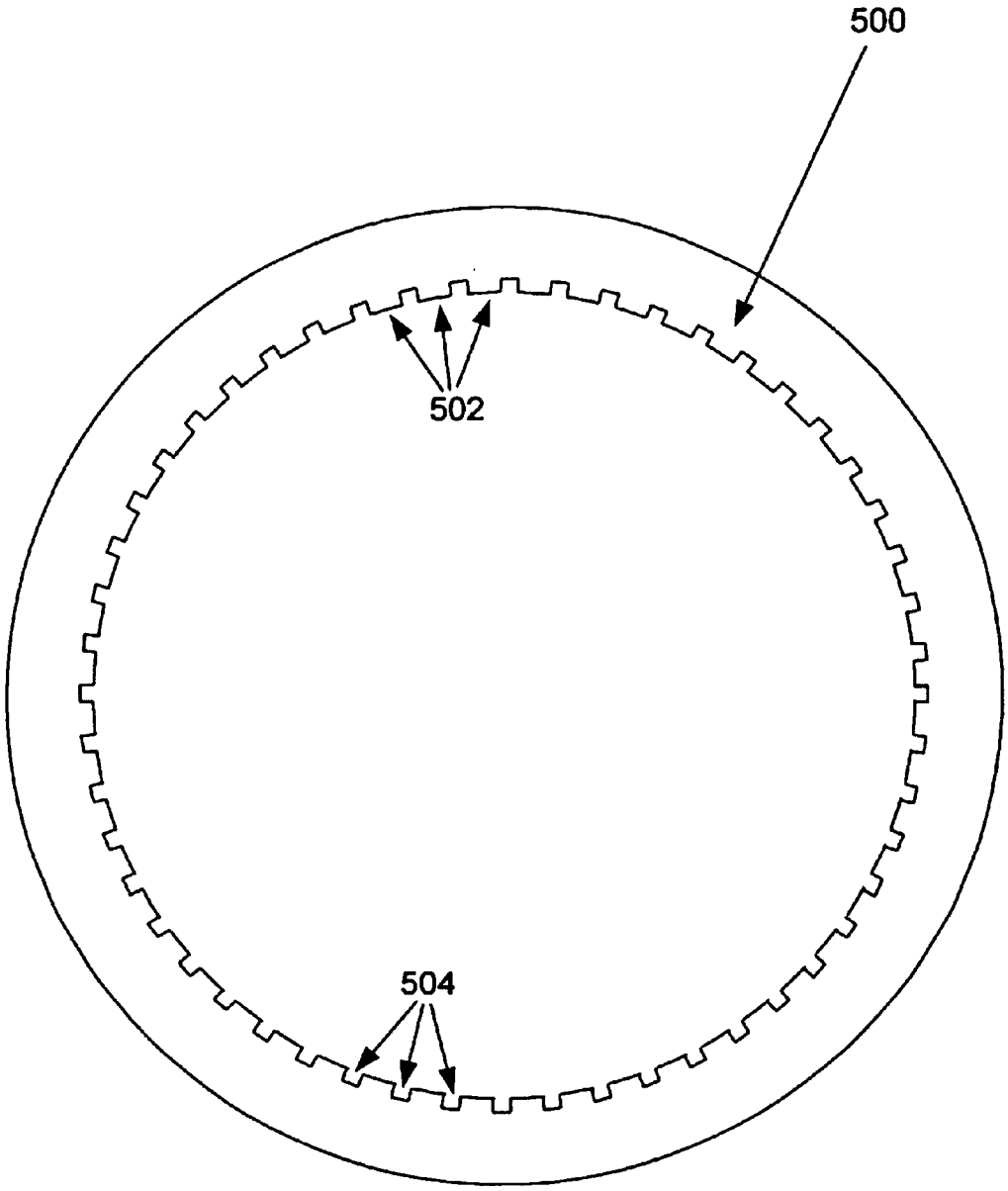
FIG. 5 is an illustration of a profiled retaining ring, in accordance with an embodiment of the present invention.

FIG. 5 is an illustration of a profiled retaining ring 500, in accordance with an embodiment of the present invention. As shown in FIG. 5, the profiled retaining ring 500 includes a plurality of profiled teeth 502 disposed along the interior surface of the annular retaining ring separated by a plurality of slots 504, and can be used to hold a flatted wafer in position during a CMP operation. To avoid wafer bending, embodiments of the present invention separate the profiled teeth 502 such that the corners along the flatted edge of the wafer do not contact more than one tooth simultaneously, as shown in FIG. 6.

Figure 6:
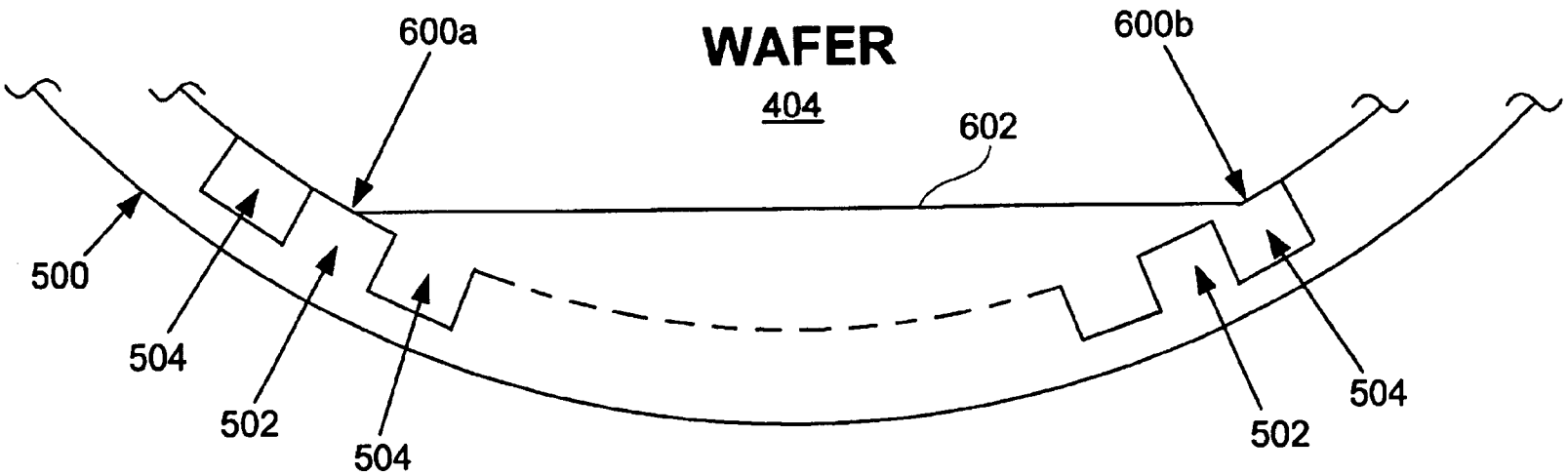
FIG. 6 is a detailed view of a section of a profiled retaining ring, in accordance with an embodiment of the present invention.

FIG. 6 is a detailed view of a section of a profiled retaining ring 500, in accordance with an embodiment of the present invention. As above, the profiled retaining ring 500 includes a plurality of profiled teeth 502 separated by a plurality of slots 504 disposed along the interior surface of the annular retaining ring 500. FIG. 6 also shows a flatted wafer 404 having a flatted edge 602 disposed between two corners 600*a* and 600*b*. For example, for an eight-inch wafer, the length of the flatted wafer edge 602 can range from about 54.62 millimeters to about 63.81 millimeters.

Figure 2:
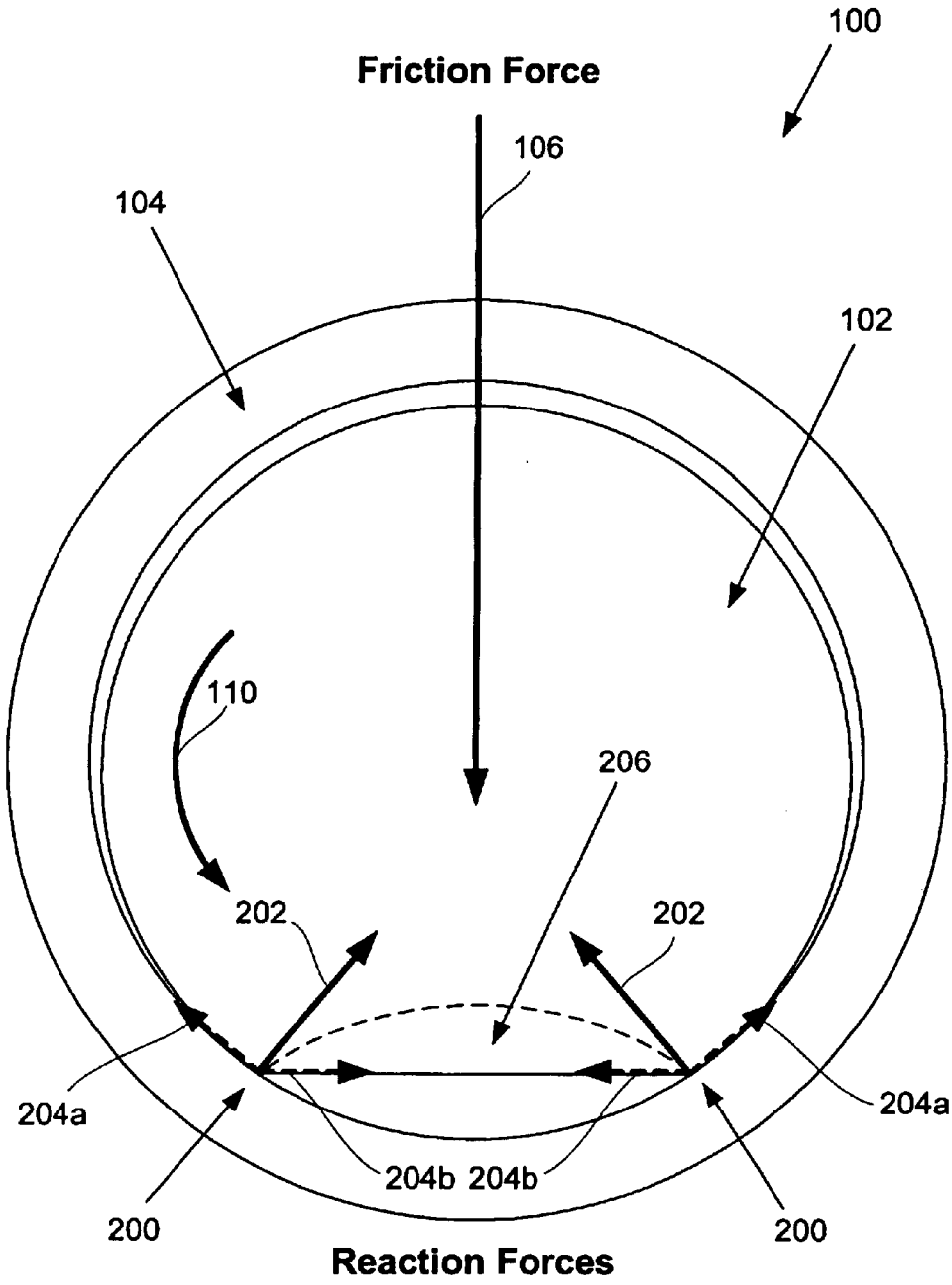
FIG. 2 (Prior Art)
FIG. 2 is an illustration showing prior art carrier head when the flatted section of the wafer contacts the conventional retaining ring.
Figure 3:
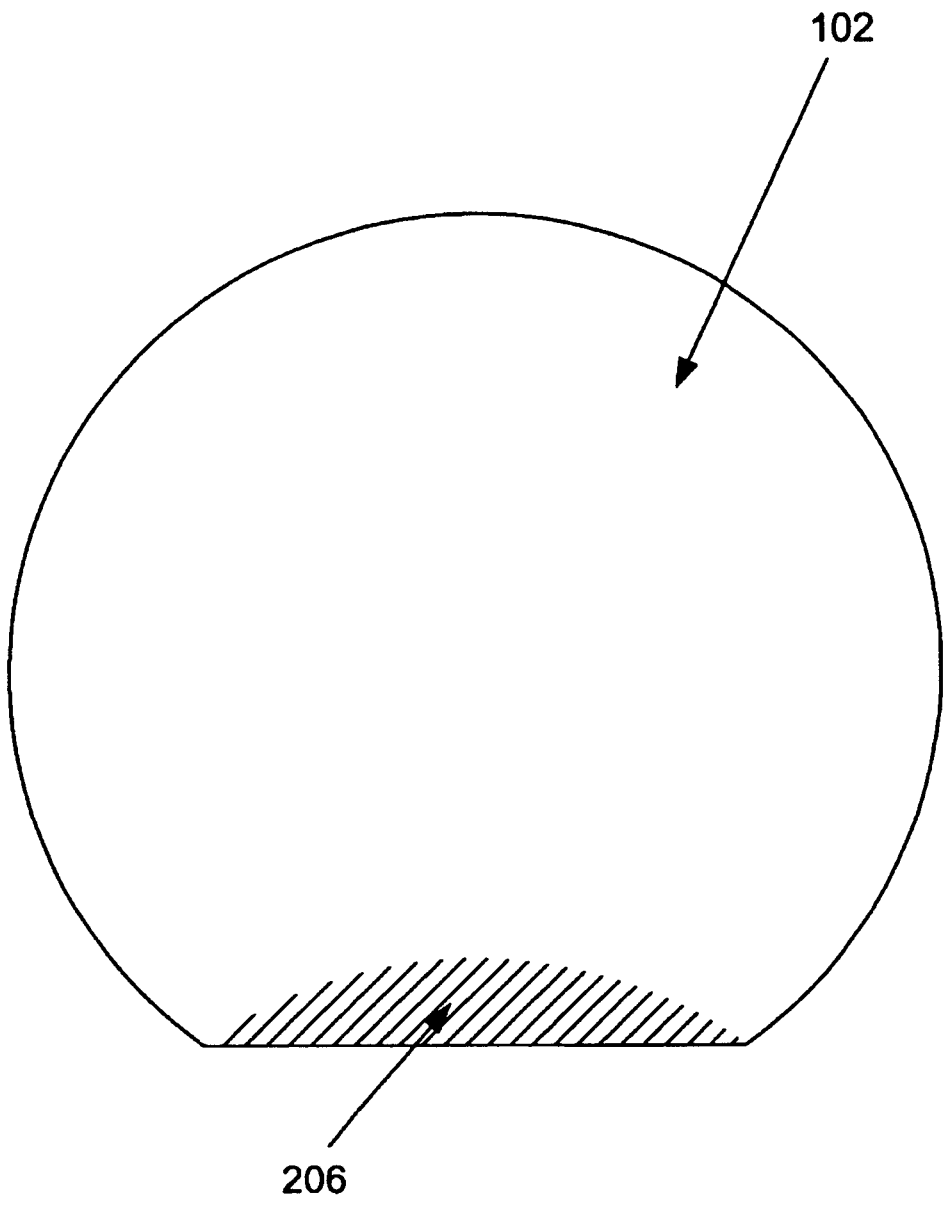
FIG. 3 (Prior Art)
FIG. 3 is an illustration showing a flatted wafer resulting from a CMP operation using a conventional retaining ring.

As mentioned above with reference to FIG. 2, when using a conventional retaining ring, force components of the reaction force from each corner 600*a* and 600*b* oppose each other and cause stress to the wafer 404. The stress causes the wafer 404 to buckle near the flatted edge 602. As a result, the buckled flatted wafer section is pushed into the polishing surface, causing over-polishing in the flatted wafer section.

Embodiments of the present invention avoid wafer bending, and thus over-polishing, by eliminating the two corner 600*a* and 600*b* reaction force interaction. In particular, the profiled retaining ring 500 ensures that only one corner 600*a* or 600*b* contacts the profiled teeth 502 of the retaining ring 500 at any particular point in time. That is, the embodiments of the present invention establish the pitch of the profiled teeth 502 such that the corners 600*a* and 600*b* along the flatted edge of the wafer do not each contact a tooth 502 of the retaining ring 500 simultaneously. Since the profiled teeth 502 are disposed completely around the interior surface of the retaining ring 500, as shown in FIG. 5, this is true at all orientations of the wafer in the retaining ring.

In the present disclosure, the term "profiled teeth" or tooth shall be used to indicate any type of profile along the interior surface of the retaining ring. For example, profiled teeth can be square as illustrated in FIG. 6, rounded, oblong, trapezoidal, or any other shape capable of allowing one corner of a flat wafer edge to contact a tooth while the opposing corner is positioned over a gap between the profiled teeth.

Figure 7:
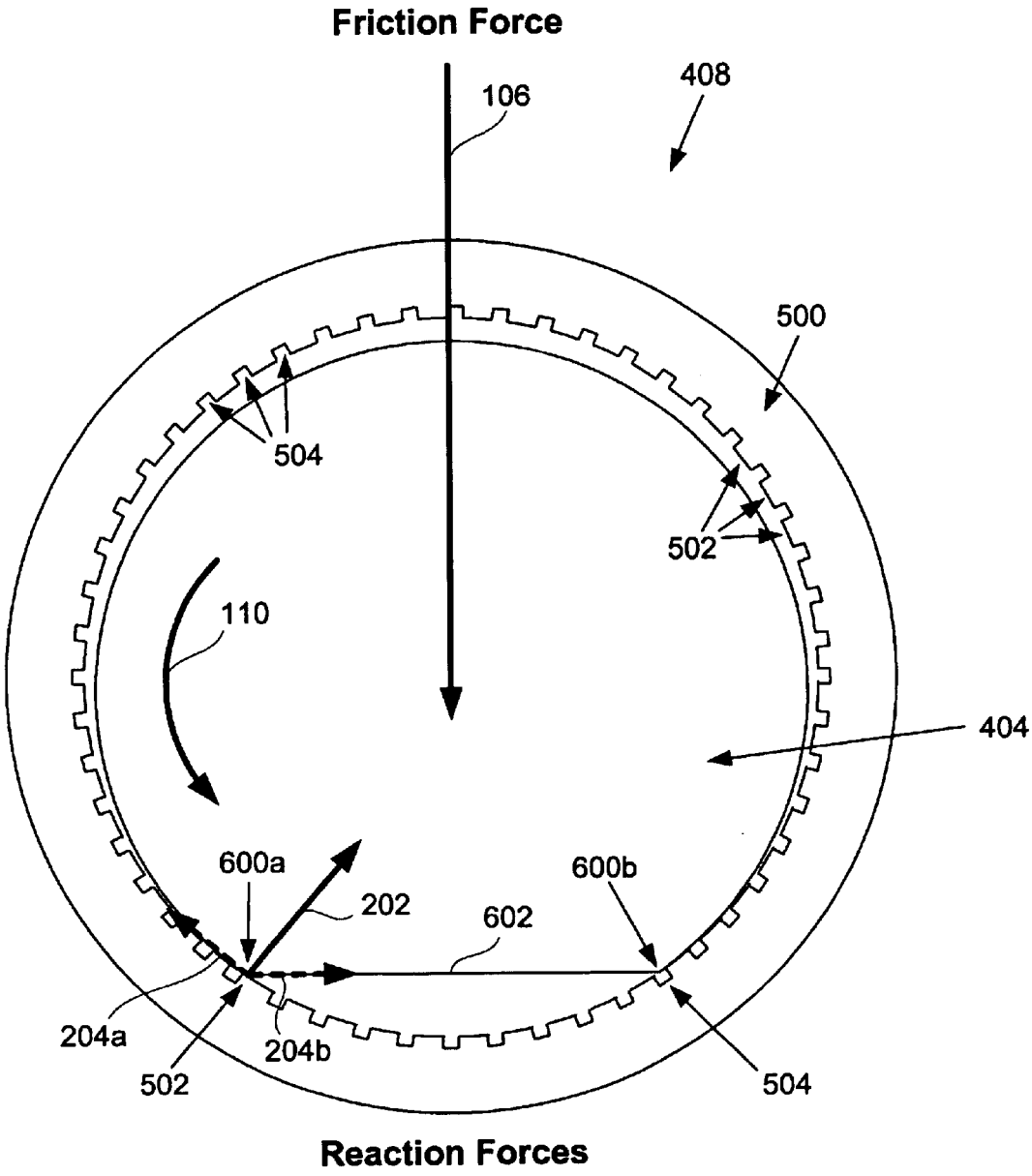
FIG. 7 is an illustration showing a carrier head having a profiled retaining ring, in accordance with an embodiment of the preset invention.

FIG. 7 is an illustration showing a carrier head 408 having a profiled retaining ring 500, in accordance with an embodiment of the preset invention. As illustrated in FIG. 7, the wafer 404 is held in position during CMP processing by the profiled retaining ring 500, which surrounds the wafer 404. As discussed previously, a small distance delta generally exist between the edge of the wafer 404 and the profiled teeth 502 of the retaining ring 500 to allow the wafer 404 to be easily positioned within the carrier head 408. During a CMP operation the carrier head 408 rotates in a direction 110 along a polishing belt or table, depending on the type of CMP system utilizing the carrier head 408. As mentioned above, the polishing surface moves beneath the wafer 404 during polishing.

The movement of the polishing surface causes a friction force 106, which is applied to the wafer 404. Because of the delta between the wafer 404 and the profiled retaining ring 500, the friction force 106 pushes the wafer 404 in the direction of the polishing surface movement until the wafer is stopped by the profiled teeth 502 of the profiled retaining ring 500. Once the wafer 404 contacts the profiled teeth 502 of the profiled retaining ring 500, a reaction force is generated from the retaining ring 500. Generally, the reaction force does not contributed greatly to uniformity errors when the rounded edges of the wafer 404 come into contact with the profiled teeth 502 of the retaining ring 500. However, because of the delta between the wafer 404 and the profiled teeth 502 of the retaining ring 500, the wafer 404 rotates within the retaining ring 502. As a result, a corner 600*a* or 600*b* of the flatted edge 602 of the wafer 404 eventually comes into contact with a tooth 502 of the retaining ring 500.

The contact of a comer 600*a* or 600*b* with a tooth 502 of the retaining ring 500 generates a reaction force 202 concentrated at the comer 600*a* or 600*b* in contact with the tooth 502. As discussed previously, the reaction force 202 can be split into component forces 204*a* and 204*b* for easier analysis. In particular, the reaction force 202 comprises a first force component 204*a*, which is directed along the rounded edge of the wafer 404, and a second force component 204*b*, which is directed along the flatted edge 602 of the wafer 404.

Figure 1:
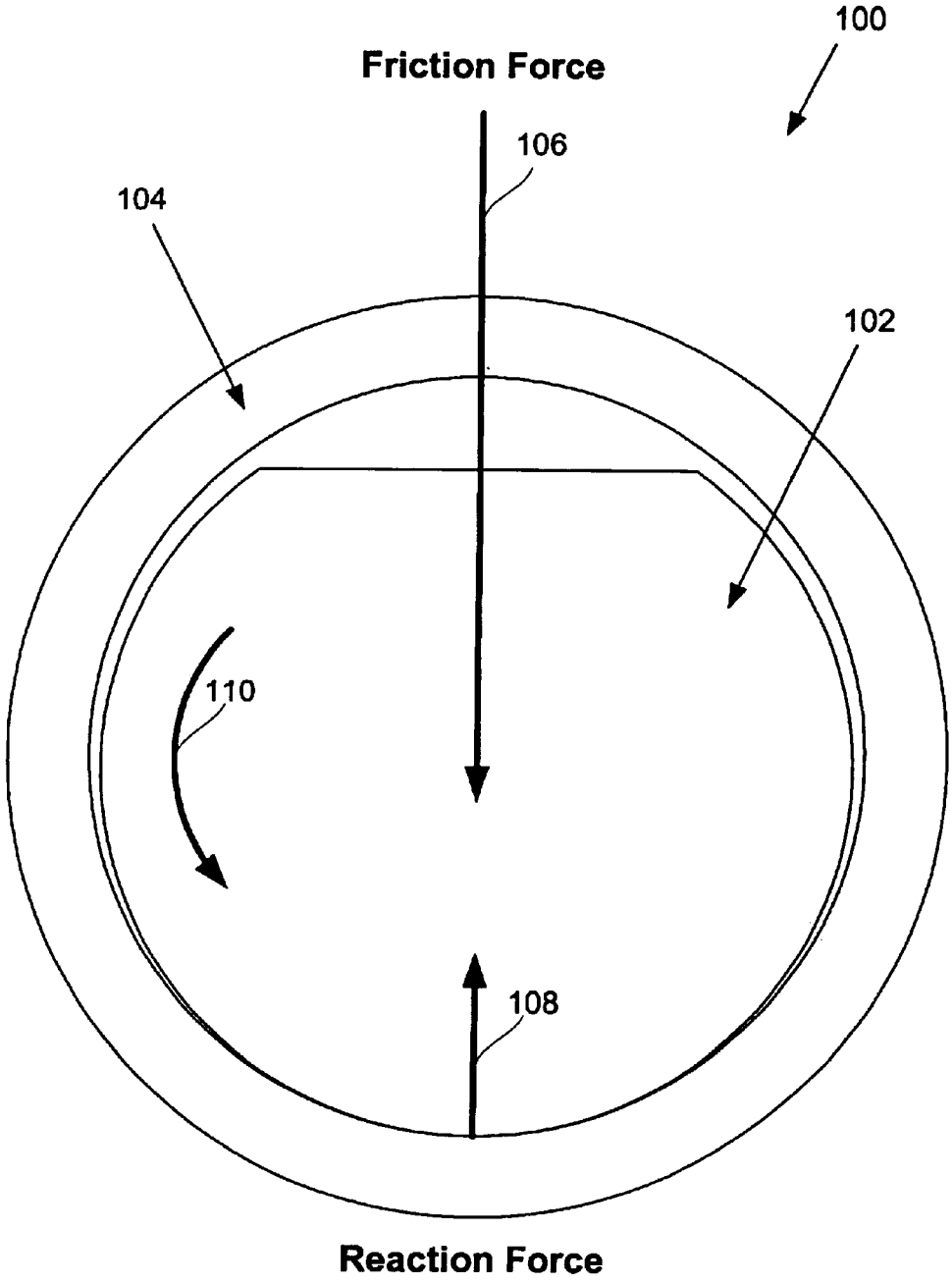
FIG. 1 (Prior Art)
FIG. 1 is a diagram showing a conventional carrier head holding a flatted wafer.

However, unlike the conventional retaining ring discussed above with reference to FIGS. 1 and 2, the profiled retaining ring 500 of the embodiments of the present invention prevents double comer interaction along the flatted edge 602 of the wafer. Specifically, the profiled teeth 502 of the retaining ring 500 are separated such that only one comer 600*a* or 600*b* can contact the profiled teeth 502 at any particular time. For example, as shown in FIG. 7, when comer 600*a* is in contact with a tooth 502, comer 600*b* is adjacent to a slot 504 between the profiled teeth 502 of the retaining ring 500. A similar situation occurs when the comer 600*b* is in contact with a tooth 502. That is, when corner 600*b* is in contact with a tooth 502, comer 600*a* is adjacent to a slot 504 between the profiled teeth 502 of the retaining ring 500.

In this manner, embodiments of the present invention advantageously avoid wafer bending, and thus over-polishing, by eliminating the two comer 600*a* and 600*b* reaction force interaction. Furthermore, as mentioned above, since the profiled teeth 502 are disposed completely around the interior surface of the retaining ring 500, this is true at all orientations of the wafer 404 in the retaining ring 500.

As will be appreciated by those skilled in the art, the exact dimensions of a wafer can vary slightly from one wafer to the next. For example, as mention previously, the length of the flatted wafer edge 602 can vary from about 54.62 millimeters to about 63.81 millimeters for an eight-inch wafer. Thus, embodiments of the present invention account for wafer size variation when selecting the pitch for the spacing of the profiled teeth 502. That is, the profiled teeth 502 are further separated such that a predefined variation in length of the flatted edge 602 of the wafer 404 will not cause the comers 600*a* and 600*b* along the flatted edge 602 to contact more than one tooth 502 simultaneously. Again, this is true for all orientations of the wafer 404 in the retaining ring 500.

Figure 8:
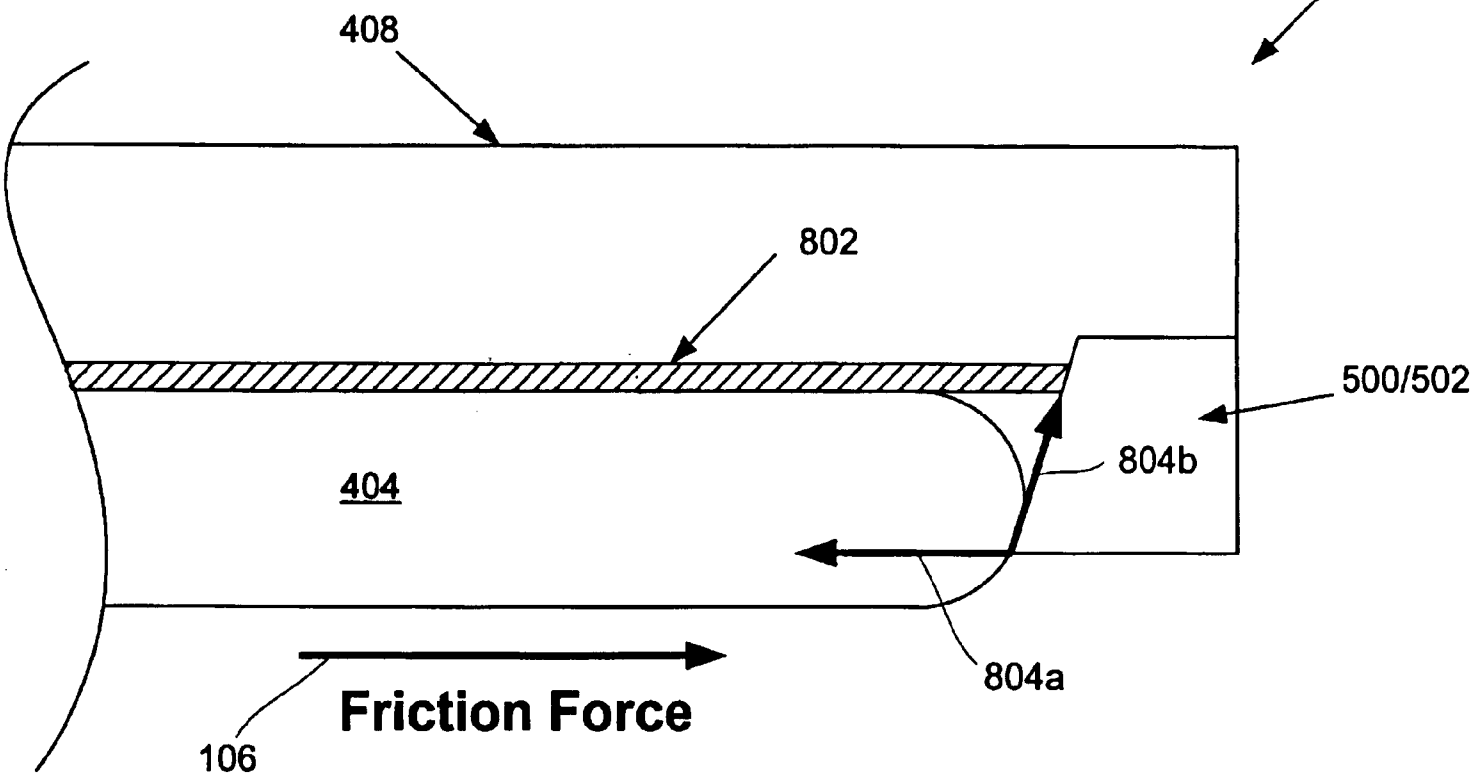
FIG. 8 is side view of an inclined retaining ring configuration, in accordance with an embodiment of the present invention.

To further improve uniformity, some embodiments of the present invention incline surfaces of the retaining ring 500 that contact the edge of the wafer, as shown in FIG. 8.

FIG. 8 is a side view of an inclined retaining ring configuration 800, in accordance with an embodiment of the present invention. As shown in FIG. 8, the retaining ring configuration 800 includes a carrier head 408 coupled to a retaining ring 500. It should be noted that the retaining ring configuration 800 can be used with non-coherent profiled teeth 502 as described above, or without profiled teeth 502. As such, the cut away retaining ring 500 in FIG. 8 can illustrate either a solid retaining ring without profiled teeth, or a tooth 502 of a profiled retaining ring.

In addition, a carrier film 802 typically is disposed between a surface of the carrier head 408 and the wafer 404. The carrier film is designed to absorb pressure during wafer polishing, thus preventing hot pressure spots from occurring on the wafer surface. The term "hot pressure spots" refers to wafer surface areas wherein increased downforce pressure results in a higher removal rate for that wafer surface area. Thus, hot pressure spots can result in non-uniformity problems during CMP processing, which are generally avoided by the use of the carrier film.

As shown in FIG. 8, a surface of each tooth 502 that contacts the wafer 404 is inclined so as to form an angle greater than 90° relative to a polishing surface and away from the center of the wafer 404. That is, an edge of the surface of each tooth 502 that contacts the wafer 404 closest to the polishing surface is also closest to a center of the wafer.

When the wafer 404 contacts a tooth 502 of the retaining ring, a reaction force is generated. Similar to above, the reaction force can be split into component forces 804*a* and 804*b* for easier analysis. In particular, the reaction force comprises a first force component 804*a*, which is directed opposite to the friction force 106, and a second force component 804*b*, which is directed along the edge of the inclined tooth 502. This second force component 804*b* will be referred to as a lifting force 804*b*.

Thus, the surface of each tooth 502 that contacts the wafer 404 is inclined such that a lifting force 804*b* is generated during the CMP operation. The lifting force 804*b* pushes the wafer 404 in a direction away from the polishing surface during CMP operations. As a result, the friction force 106 is reduced. Further, local over-polishing is reduced along the edge of the wafer 404, thus reducing the occurrence of edge effect. Edge effect refers to an increased removal rate at the edge of the wafer. Again, it should be noted that the above described inclined retaining configuration 800 can be utilized with both a profiled teeth retaining ring and a standard retaining ring, that is, a retaining ring that does not include profiled teeth.

Thus, embodiments of the present invention advantageously avoid wafer bending, and thus over-polishing, by eliminating the two comer reaction force interaction. Furthermore, as mentioned above, since the profiled teeth are disposed completely around the interior surface of the retaining ring, this is true at all orientations of the wafer 404 in the retaining ring. Moreover, by inclining the internal surfaces of the retaining ring, such as the ring itself or the profiled teeth of the profiled retaining ring, embodiments of the present invention can reduce friction force and edge effect.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A retaining ring system for use in a chemical mechanical planarization on (CMP) system, the retaining ring system comprising:

a flatted wafer having an arcuate-shaped periphery intersected by a flat to define a first corner spaced from a second corner; and an annular retaining ring configured to retain the flatted wafer in position during a CMP operation, the ring being configured with an interior surface and the retaining comprising the interior surface of the ring touching only one the first and second corners at any particular time during the CMP operation, the interior surface being configured with a plurality of spaced teeth separated by a plurality of slots, the configuration of the interior surface being that the teeth are separated from each other by the slots such that during the retaining of the wafer one tooth touches the first corner and no other teeth touch the second corner of the wafer at the any particular time.

2. A retaining ring system as recited in claim 1, wherein the wafer has a predefined variation in length of the flat, and wherein the teeth of the ring are separated such that at all orientations of the wafer in the retaining ring only the one tooth touches the first corner and no other teeth touch the second.

3. A retaining ring system as recited in claim 1, wherein the teeth are configured with a tooth surface that contacts the wafer and wherein the tooth surface is inclined at an angle greater than 90° relative to a polishing surface and away from a center of the wafer.

4. A retaining ring system as recited in claim 3, wherein the tooth surface is configured with an edge, the edge contacting the wafer adjacent to the polishing surface, the edge also being closer to the center of the wafer than any other part of the surface of each tooth that contacts the wafer.

5. A retaining ring system as recited in claim 4, wherein the incline of the tooth surface is such that a lifting force is generated during the CMP operation, the incline being configured so that the lifting force pushes the wafer in a direction away from the polishing surface.

6. A retaining ring system for use in a chemical mechanical planarization (CMP) system, the retaining ring system comprising:

a flatted wafer having a flat edge that defines a first corner and a second corner; and an annular retaining ring configured to retain the flatted wafer in position during a CMP operation, the ring defining a plane, the ring being configured with an interior surface, the interior surface of the ring retaining the wafer by contact with one of the first and second corners, the interior surface being configured with a plurality of profiled teeth, wherein a tooth surface of each tooth that contacts the wafer is inclined at an angle greater than 90° relative to the plane, the angle extending away from a center of the ring.

7. A retaining ring system as recited in claim 6, wherein during the CMP operation a polishing surface is applied to the wafer, and wherein the incline of the tooth surface is such that during the CMP operation a lifting force pushes the wafer in a direction away from the polishing surface.

8. A retaining ring system as recited in claim 6, wherein the profiled teeth are separated from each other such that simultaneously at all orientations of the wafer in the retaining ring only one profiled tooth contacts the first corner and no other profiled tooth contacts the second corner.

9. A retaining ring system as recited in claim 8, wherein the wafer may have a predefined variation in a length of the flat edge of the wafer, and wherein the separation of the profiled teeth from each other is such that despite the predefined variation in the length simultaneously at all orientations of the wafer in the retaining ring only the one profiled tooth contacts the first corner and no other profiled tooth contacts the second corner.

10. A retaining ring system for use in a chemical mechanical planarization (CMP) system, comprising:

a flatted wafer having a flatted edge, a first corner and a second corner, the first and second corners being at opposite ends of the flatted edge of the wafer;

an annular retaining ring configured to hold the a flatted wafer in position during a CMP operation, the annular ring defining a plane, the ring being configured with an interior surface that contacts the first corner of the flatted edge to hold the wafer in the position, the interior surface being configured with a plurality of profiled teeth, adjacent ones of the teeth being separated by a slot;

wherein the profiled teeth are separated from each other such that the interior surface that contacts the first corner of the flatted edge to hold the wafer in position is a first of the profiled teeth and during the contacting of the first tooth and the first corner, the second corner of the wafer is opposite to one of the slot and the second corner is not contacting either of the teeth that are adjacent to the slot that is opposite to the second corner, and wherein the first corner and the second corner of the wafer do not contact profiled teeth simultaneously at all orientations of the wafer in the retaining ring;

wherein each profiled tooth is configured with surface for contacting the wafer, the tooth surface being inclined so that the tooth surface is at an angle greater than 90° relative to the plane and is inclined away from center of the ring.

11. A retaining ring system as recited in claim 10, wherein the profiled teeth and slots are configured so that at all orientations of the wafer in the retaining ring during the contacting of the first tooth and the first corner, notwithstanding a predetermined variation in a length of the flatted edge of the wafer, the second corner of the flatted wafer is opposite to the one of the slots and is not in contact with any other one of the profiled teeth.

12. A retaining ring system as recited in claim 11, wherein a polishing surface is configured to be applied to the wafer held in position by the ring, and wherein the inclined tooth surface of each tooth that contacts the wafer applies a lifting force to push the wafer in a direction away from the polishing surface and reduce local over-polishing along an edge of the wafer adjacent to the contact with the first tooth.

13. A system use during a chemical mechanical planarization (CMP) system, the system comprising:

a flatted wafer having a flat that defines a corner at each of the flat, a first corner of the corners being spaced from a second corner of the corners by a nominal distance; and annular structure configured with an opening and an interior surface of the opening in which to receive the flatted wafer for retention during a CMP operation, the interior surface being configured with an alternating sequence of a tooth and a slot, the sequence being repeated completely around the interior surface, the sequence having a pitch from a first of the teeth across one of the slots to a next tooth, the pitch being configured so that the first tooth and a subsequent tooth are separated by a first multiple of the pitch, wherein the first multiple of the pitch is less than a value of the nominal distance, the pitch being configured so that the first tooth and a next subsequent tooth are separated by a second multiple of the pitch, wherein the second multiple of the pitch is greater than the value of the nominal distance, whereby, when the flatted wafer is received in the opening at any orientation of the flat relative to the teeth, and when the first tooth is in contact with the first corner, one of the slots is opposite to the second corner.

14. A system as recited in claim 13, wherein the teeth are configured with a tooth surface that contacts the wafer, and wherein the tooth surface is inclined at an angle greater than 90° relative to a plane defined by the ring, the angle being directed away from a center of the opening.

15. A method of making a ring for retaining a wafer during a chemical mechanical planarization (CMP) operation, the method comprising the operations of:

providing an annular retaining ring having a central opening defining a generally circular interior surface, the opening being configured to receive a flatted wafer having a flat that defines corners at each of two opposite ends of the flat, the corners being spaced by a distance that may vary within a range of variation;

establishing a value of a pitch in coordination with a value of the distance that is within the range of variation; and configuring the interior surface with a sequence of a tooth and a slot with the sequence extending continuously around the interior surface and adjacent ones of the teeth being separated by the value of the pitch resulting from the establishing operation so that at any particular time during the retaining of the wafer one tooth contacts the first corner and no other teeth touch the second corner of the wafer.

16. A method as recited in claim 15, further comprising the operation of:

configuring the teeth with a tooth surface that contacts the wafer, and wherein the tooth surface is inclined at an angle greater than 90° relative to a plane defined by the ring, the angle being directed away from a center of the central opening of the ring.

* * * * *